US005466130A

United States Patent [19]

Kobelt

[11] Patent Number: 5,466,130

[45] Date of Patent: Nov. 14, 1995

[54] HELM PUMP

[76] Inventor: Jacob Kobelt, 1654 Ocean Park Road, Surrey, British Columbia, Canada, 4VA 3L9

[21] Appl. No.: 280,536

[22] Filed: Jul. 26, 1994

[51] Int. Cl.[6] ..... F04B 1/20

[52] U.S. Cl. ..... 417/269; 417/554

[58] Field of Search ..... 417/269, 554; 92/71, 79, 183; 91/499

[56] References Cited

U.S. PATENT DOCUMENTS

| | | | |
|---|---|---|---|
| 2,345,446 | 3/1944 | Baker | 103/162 |
| 2,492,688 | 12/1949 | Dall | 103/166 |
| 2,667,862 | 2/1954 | Muller | 121/62 |
| 2,699,123 | 1/1955 | Bonnette et al. | 103/162 |
| 2,769,393 | 11/1956 | Cardillo et al. | 103/5 |
| 2,842,068 | 7/1958 | Sundin | 103/166 |
| 2,915,985 | 12/1959 | Budzich | 103/162 |
| 3,159,041 | 12/1964 | Firth et al. | 74/60 |
| 3,190,232 | 6/1965 | Budzich | 103/162 |
| 3,266,434 | 8/1966 | McAlvay | 103/162 |
| 3,303,749 | 2/1967 | Ocule | 91/499 |
| 3,384,028 | 5/1968 | Thoma | 103/162 |
| 3,422,767 | 1/1969 | McAlvay | 103/162 |
| 3,453,965 | 7/1969 | Heinrich | 91/499 |
| 3,739,691 | 6/1973 | Bobler | 91/506 |
| 3,803,987 | 4/1974 | Knapp | 91/506 |
| 3,935,796 | 2/1976 | Wood | 92/12.2 |
| 4,765,228 | 8/1988 | Wagenseil | 91/499 |
| 4,898,077 | 2/1990 | McBeth | 91/499 |
| 5,058,485 | 10/1991 | Cardillo | 91/499 |

*Primary Examiner*—Richard A. Bertsch
*Assistant Examiner*—William Wicker
*Attorney, Agent, or Firm*—Bull, Housser & Tupper

[57] ABSTRACT

A swash plate pump is particularly adapted for use as a helm pump for controlling a tiller of a marine vessel and has a rotor mounted within a pump housing. The rotor is rotatable by a wheel about a housing axis and has a plurality of cylinders therein disposed circumferentially around the rotor. A piston is resiliently mounted in each cylinder for reciprocal movement along a respective cylinder axis so that outer ends of the pistons engage a swash plate inclined obliquely to the housing axis at a fixed swash plate angle. Bleed conduits are provided in the outer ends of each piston, each bleed conduit having an opening disposed on the respective cylinder axis. The outer end of each piston is shaped to provide access to the bleed conduit between the bearing plate and the outer end of the piston, preferably by having a truncated conical end wall inclined at an end face angle equal to the swash plate angle to provide line contact between the end wall and the swash plate.

16 Claims, 2 Drawing Sheets

HELM PUMP

BACKGROUND OF THE INVENTION

The invention relates to a swash plate pump, particularly a swash plate pump used as a helm pump for providing pressurized fluid to a hydraulic fluid actuator which controls a marine vessel tiller.

Swash plate pumps have been used for many years as helm pumps to supply pressurized fluid to hydraulic actuator cylinders to actuate the tiller. Such pumps have a housing and a pump rotor journalled for rotation within the housing by rotating a steering wheel. The rotor has a plurality of circumferentially disposed cylinders containing respective pistons which are held resiliently against an inclined swash plate as the rotor is rotated relative to the housing. Such pumps are usually a portion of a closed hydraulic circuit in which fluid from the pump is supplied to one side of a piston of the actuator cylinder, and displaced fluid from an opposite side of the piston is returned to the housing to be fed back into the rotor. In effect the housing serves as a sump to receive fluid returned from the actuator cylinder.

To provide an operator with a variable "gear ratio" for actuation of the tiller, some helm pumps have a variable displacement by providing a swash plate with a variable angle. In this way, in heavy seas the swash plate is set almost perpendicularly to a pump axis and the helm pump delivers a relatively small volume of fluid for a given number of turns of the wheel. However, in lighter seas, the swash plate is set more obliquely and the helm pump delivers a greater volume of fluid for the same number of turns of the wheel. One helm pump of this general type is disclosed in U.S. Pat. No. 3,935,796 (Wood), which shows screw thread means for adjusting angle of inclination of the swash plate. Other U.S. patents of this general type of pump include U.S. Pat. Nos. 3,384,028 (Thoma), 3,190,232 (Budzich) and 2,769,393 (Cordillo et al).

In some variable displacement pumps, outer ends of the pistons contacting the swash plate are provided with a partially spherical contact point which can accommodate different angles of inclination of the piston to the swash plate. While a variable displacement pump is desirable in some circumstances, because the ends of the pistons must accommodate different angles of the swash plate, a relatively small radius contact tip is commonly used, which is subject to relatively high rates of wear due to relatively high bearing stresses as the pistons sweep the swash plate. To reduce wear rates, it is common to insert a steel ball at an outer end of the piston located on a central axis of the cylinder, which, while reducing wear problems, increases manufacturing costs.

In addition, whenever a hydraulic system is installed or serviced, air trapped in the system must be purged, usually by displacing air and fluid through bleed valves or purge valves. When a helm pump is driven directly by a vertically disposed wheel at the helm, an axis of rotation of the rotor is generally horizontal and it is usually necessary to provide a bleed valve for each cylinder. In instances where a steel ball is used to reduce wear of the piston, usually two or three arcuate portions of bleed conduits are provided on opposite sides of the ball to permit purging of the cylinders, irrespective of the direction of rotation of the cylinders. Such conduits are located away from the central axis of the cylinder where the conduits break out of the piston, as the central axial position is occupied by the steel ball. In general, it is a relatively costly manufacturing procedure to install a steel ball at an end of a piston and provide the several arcuate bleed conduits extending around the ball.

SUMMARY OF THE INVENTION

The invention reduces the difficulties and disadvantages of the prior art by providing a swash plate pump which is particularly adapted to be a helm pump of a fixed displacement type. The invention simplifies manufacturing by eliminating the prior art steel balls which are commonly fitted at the outer ends of the pistons to reduce wear of the pistons as they sweep the swash plate. In addition, point contact between the piston and swash plate is eliminated and line contact substituted, which reduces bearing loads and corresponding wear between the outer ends of the pistons and the swash plate. Thus, initial investment costs and subsequent maintenance costs are reduced by the present invention when compared with the conventional helm pump.

A swash plate pump according to the invention comprises a pump housing, a pump rotor, a plurality of pistons, a swash plate, inlet and outlet conduits, and bleed conduits. The pump housing has a longitudinal housing axis extending between opposite first and second end portions of the housing. The pump rotor is journalled for rotation relative to the housing about the housing axis and has a plurality of cylinders therein. Each piston of the plurality of pistons has inner and outer ends and is slidable within a respective cylinder of the rotor along a respective cylinder axis. The swash plate has a bearing plate engaging the outer ends of the pistons, the bearing plate being inclined at a swash plate angle to the longitudinal housing axis. The inlet and outlet conduits communicate with the cylinders and have respective valves for supplying fluid to and for discharging fluid from each cylinder. The bleed conduits bleed the cylinders, a bleed conduit being provided in the outer end of each respective piston and having an opening disposed on the respective cylinder axis. The outer end of each piston is shaped to provide access to the bleed conduit between the bearing plate and the outer end of the piston.

Preferably, the outer end of the pistons are partially conical and have a truncated end wall extending around the bleed conduit. Preferably, line contact exists between the truncated conical end wall and the bearing plate of the swash plate. In some embodiments, the cylinder axes are parallel to the longitudinal housing axis, and preferably the truncated conical end wall of each piston is inclined with respect to cylinder axis at an end face angle which is equal to the swash plate angle. In this way, the bearing plate of the swash plate engages the outer end wall of the piston with line contact between the end wall of the piston and the bearing plate.

A detailed disclosure following, related to drawings, describes a preferred embodiment of the invention which is capable of expression in structure other than that particularly described and illustrated.

DETAILED DESCRIPTION

Figure 1:
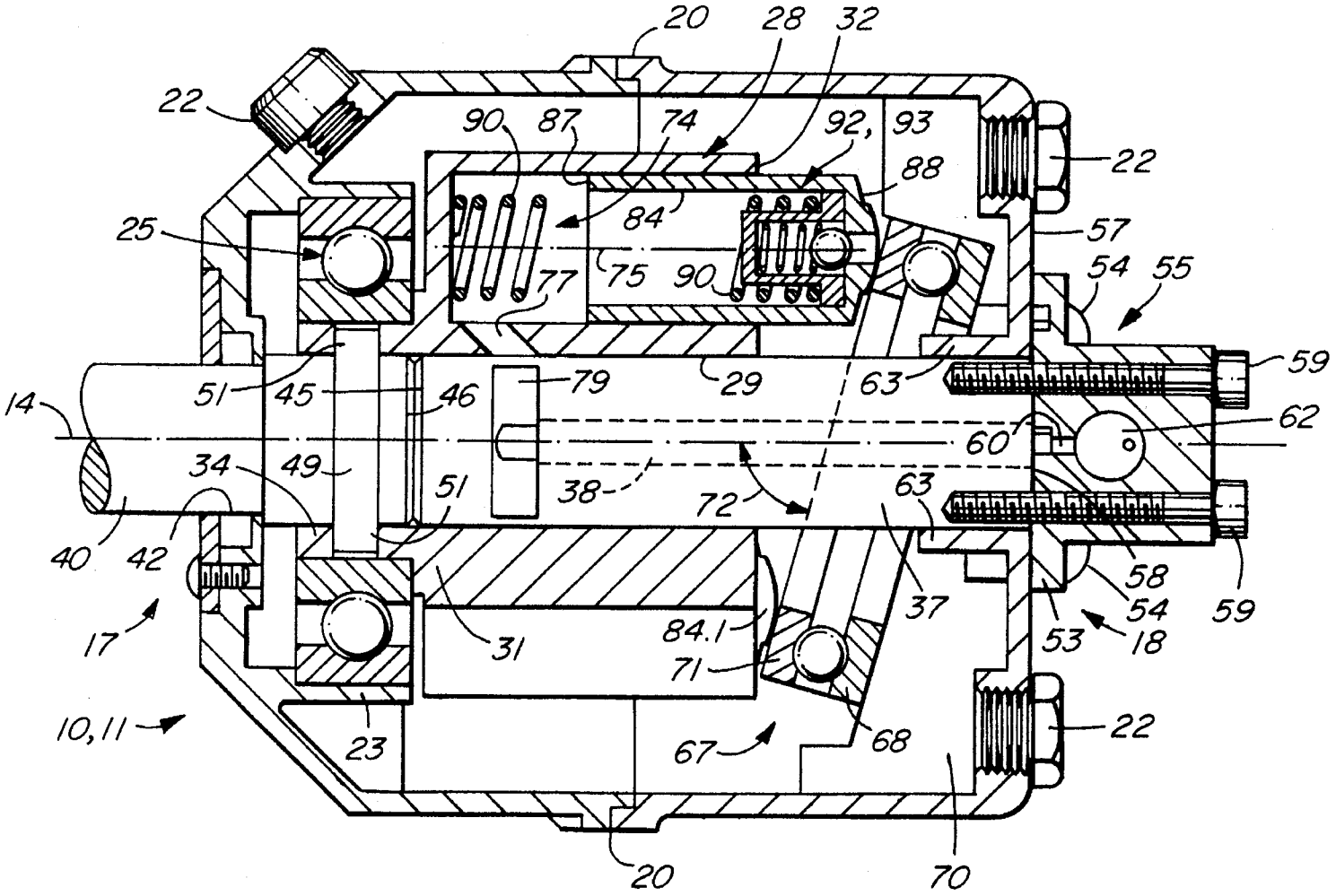
FIG. 1 is a simplified, fragmented, longitudinal section through a helm pump according to the invention, some portions being shown simplified or omitted for clarity.
Figure 2:
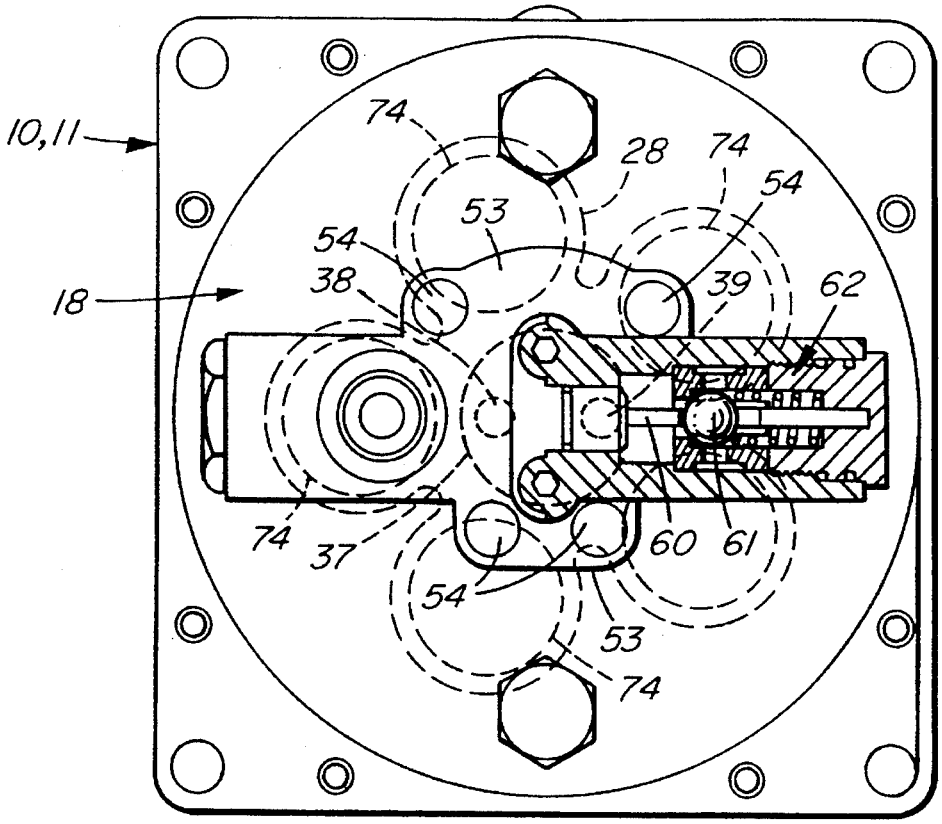
FIG. 2 is a simplified partial end view and transverse section of the pump of FIG. 1 showing some internal detail and a section of a valve associated with the pump.

FIGS. 1 and 2

Referring mainly to FIG. 1, a helm pump 10 according to the invention has a pump housing 11 having a longitudinal housing axis 14 extending between opposite first and second end portions 17 and 18 of the housing. The first and second end portions have respective inner edges sealably interconnected at an annular join 20 in a diametrical plane of the housing with fastener means, not shown, interconnecting the first and second end portions together to form a fluid tight housing. The end portions 17 and 18 have threaded plugs or couplings, severally 22, which seal complementary openings in the end portions or serve as conduit connections for connecting conduits to other helm pumps at other stations for admitting or discharging fluid, purging the system of air, etc., as is well known.

The first end portion 17 has an annular bearing retainer 23 which retains an outer race of a ball bearing assembly, which serves as a rotor bearing 25. The helm pump further includes a pump rotor 28 having a central bore 29 and first and second end portions 31 and 32, the first end portion 31 having a bearing sleeve 34 which is retained within an inner race of the rotor bearing 25. Thus, the first end portion 31 of the rotor 28 is journalled for rotation with respect to the housing 11 by the bearing 25.

A rotor engaging shaft or "pintle" 37 extends inwardly from the second end portion 18 of the housing along and concentric with the longitudinal housing axis 14, and is received in the central bore 29 of the pump rotor to assist in journalling the rotor 28. As best seen in FIG. 2, first and second fluid conduits 38 and 39 extend axially along the shaft 37 to supply fluid to, and receive fluid from, the rotor 28 as will be described. A drive shaft 40 extends inwardly through a sealed opening 42 in the first end portion 17, and has an inner end received in the central bore 29 of the pump rotor and thus is axially aligned with the rotor engaging shaft 37 and journalled by the rotor bearing 25. Inner end faces 45 and 46 of the shafts 37 and 40 are thus adjacent each other within the bore 29. A drive pin 49 is received in a transverse bore in the shaft 40 so as to extend diametrically across the drive shaft 40 adjacent the end face 46. Outer ends of the pin 49 are received in complementary openings 51 of the rotor to transmit drive from the drive shaft 40 to the rotor. Thus, the drive shaft extends through and is journalled for rotation relative to the first end portion of the housing and cooperates with the rotor to rotate the rotor.

The helm pump further comprises a directional valve housing 55 secured to a housing end face 57 of the second end portion be of the housing by screws 54 passing through a peripheral flange 53 of the housing 55. The engaging shaft 37 has an outer end face 58 secured to an inner face of the valve housing 55 by screws 59 which pass through the valve housing and draw the engaging shaft against the valve housing. The shaft 37 is a relatively snug fit in an annular flange 63 extending inwardly from the end face 57 to engage the outer end of the engaging shaft to further secure the shaft 37. The conduits 38 and 39 cooperate with corresponding valve conduits in the valve housing 55 to communicate with lock or check valves in the housing, one valve conduit 60 which cooperates with a corresponding check valve 62 only being shown. The valve 62 has a ball 61 which is spring urged against an undesignated complementary valve seat to control flow with respect to the valve conduit 60. A similar valve, not shown, cooperates with the conduit 38 and is mounted in a similar configuration to that shown for the valve 62 to control fluid flow with respect to the conduit 38. Thus, the housing 55 has check valves to control flow with respect to the rotor and functions similarly to equivalent valves as described in the said U.S. patent to Wood. For one particular direction of rotation of the rotor 28, the first fluid conduit 38 can serve as an inlet conduit, and the second fluid conduit 39 can serve as an outlet conduit. Clearly, the inlet and outlet conduits communicate with the cylinders and have respective valves for supplying fluid to and discharging fluid from each cylinder sequentially as the rotor rotates, as is common in this type of pump. Thus, the rotor engaging shaft or pintle extends from the second end portion of the housing along the longitudinal housing axis and has inlet and outlet conduits and respective valves cooperating with the rotor to control flow therethrough.

A swash plate bearing or thrust bearing 67 has an outer race 68 carried on an outer race support 70 which locates the bearing so that an inner race thereof, termed a bearing plate or swash plate 71, is located at a swash plate angle 72 measured with respect to the longitudinal housing axis 14 as shown.

As shown in section in FIG. 1 and in broken outline in FIG. 2, the pump rotor 28 has a plurality of axially disposed cylinders 74, five cylinders being shown in FIG. 2 spaced circumferentially apart equally around the rotor. As best seen in FIG. 1, the rotor has a first fluid port 77 communicating with an inner end of the adjacent cylinder 74 and extending inwardly into the bore 29. Each cylinder 74 has a similar port 77, and as the rotor rotates each port 77 communicates sequentially with a first manifold 79 in the rotor engaging shaft 37 when the rotor is positioned generally as drawn. The first manifold 79 communicates with the first fluid conduit 38 which is controlled by the valve 62 and thus transmits fluid sequentially between the cylinders and the shaft 37 as the rotor sweeps through a particular angle with respect to the housing as is well known. Similarly, a second fluid port and associated second manifold are located on a diametrically opposite portion of the shaft 37, and are not shown herein. The second port and manifold similarly communicate with the second conduit 39 and transmit fluid between the cylinders and the shaft 37 as the rotor rotates through an oppositely disposed particular angle with respect to the housing.

The pump 10 further comprises a plurality of pistons 84 slidable within the respective cylinders 74 of the rotors along respective cylinder axes 75, which axes are parallel to the housing axis 14. A typical piston 84 is shown in FIG. 1 and is a tube having an open inner end 87 facing into the cylinder 74, and an essentially closed outer end 88 projecting from the second end portion 32 of the rotor. A compression coil piston spring 90 extends between a closed end face of the cylinder 74 and the outer end 88 of the piston. Thus, the spring 90 resiliently urges the piston outwardly of the respective cylinder, so that the outer end 88 contacts the bearing plate or swash plate 71 of the swash plate thrust bearing 67. Thus, the outer ends of the pistons engage the bearing plate which is inclined at the swash plate angle 72 as shown and sweeps the plate as the rotor rotates about the axis 14. As seen in FIG. 1, the piston 84 is located at an upper portion of the housing in a maximum volume position, and thus is termed bottom dead centre. In contrast, a piston 84.1, shown partially in FIG. 1, is generally adjacent a diametrically opposite side of the rotor from the upper piston and is shown essentially fully depressed into the cylinder for an approximate minimum volume, representing a top dead centre position. The valves in the housing 55 communicate with the inlet and outlet conduits of the shaft 37 and control flow through the inlet and outlet conduits in response to movement of the pistons with respect to the ports as is well known. Control means associated with the valves in the housing 55 are well known and further description is deemed unnecessary, e.g. as referenced in the said U.S. patent to Wood.

Figure 3:
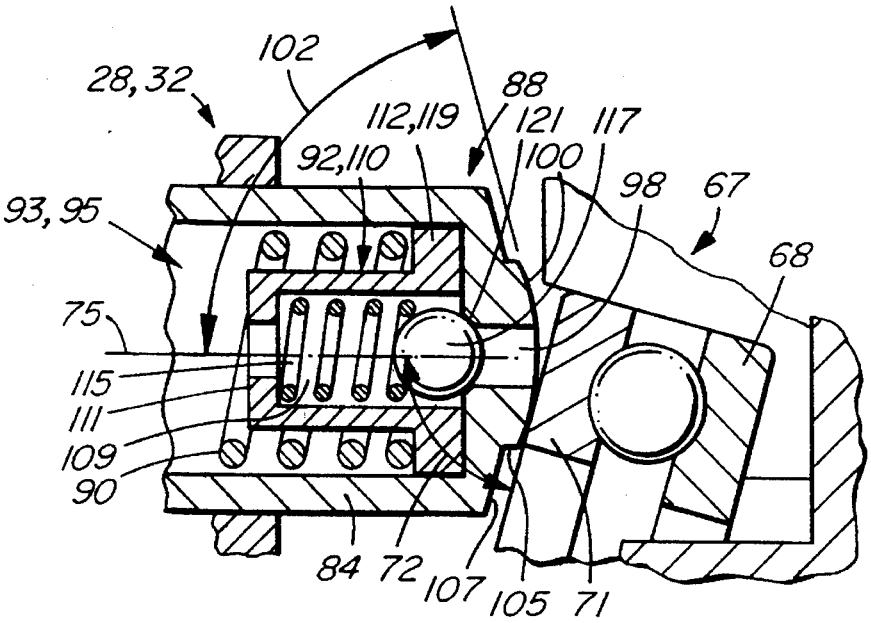
FIG. 3 is a fragmented schematic of an outer end of a piston contacting a portion of a swash plate, the view being at an enlarged scale but generally similar to that shown at a smaller scale in FIG. 1.

The above structure describes a swash plate pump which has many similarities with conventional prior art helm pumps, e.g. the said Wood Patent, which have been used for many years in the marine industry. Such pumps are commonly mounted horizontally and in this orientation require means to purge air from the system when the system is being installed, or has been serviced. It is common practice to provide a purge or bleed valve or valves within the pump, and usually each cylinder has its own purge or bleed valve. The present invention provides a simplified bleed means when compared with the prior art, and thus reduces manufacturing costs. Each piston 84 has a bleed means 93 for bleeding the respective cylinder, the bleed means having a normally-closed bleed valve 95. Further details of the bleed means 93 according to the invention are described with reference to FIG. 3.

FIG. 3

The bleed means 93 further comprises the outer end 88 of the piston having a bleed conduit 98 extending therethrough and disposed on the cylinder axis to communicate with the cylinder and the interior of the housing. The bleed conduit is straight and has openings at opposite ends thereof located on the particular cylinder axis to simplify manufacturing. The outer end of the piston is partially conical and has a truncated conical end wall 100 extending circumferentially around the bleed conduit 98. The end wall 100 is inclined to the respective cylinder axis at an end wall angle 102, which is a half-conical angle of a theoretical cone defining the end wall 100. The outer end of the piston is shaped to provide access to the bleed conduit between the bearing plate and the outer end of the piston for any relative position of the piston and bearing plate so that fluid can pass between the outer end of the piston and the bearing plate at any time. This is attained by ensuring that the conduit has a size which produces an adequate clearance due to the slight truncation of the end face. In addition, to reduce wear between the outer end of the piston and the bearing plate, there is line contact between the truncated conical end wall 100 of the piston and the bearing plate. Line contact, preferably extending along a radius of the cylinder/piston, is superior to point contact commonly found in the prior art structure as bearing stresses are reduced, and thus wear between the end face of the piston and the bearing plate of the swash plate is reduced from what would otherwise occur with point contact, other factors being equal.

To attain the said line contact, because the housing axis 14 and the cylinder axis 75 are parallel to each other, the end wall angle 102 is equal to the swash plate angle 72, both angles being measured with respect to the parallel axes 14 and 75. Clearly, if the axis 75 were inclined to the axis 14 as is found in some swash plate pumps, different geometry would apply, but in any event it would be possible to select an end face angle compatible with the angle 102 which would permit line contact between the end face of the piston and the swash plate bearing plate. As the angle 102 of the end face is fixed, clearly the swash plate angle must be fixed to maintain the line contact as described above, and consequently this aspect of the invention is only appropriate for a helm pump with a fixed swash plate, that is a fixed displacement helm pump.

To improve manufacturing and wear tolerance to prevent inadvertent contact between outer portions of the piston end face and the swash plate, the outer end of the piston has an annular step 105 extending concentrically around the truncated conical end wall 100 of the piston. In addition, an outer truncated conical land portion 107 extends around the step 105 and is spaced inwardly from the conical end wall 100 towards the inner end of the piston. In this way, the outer land portion 107 is recessed with respect to the conical end wall 100 to avoid possible interference of the end wall 100 with the bearing plate 71. It can be seen that radial width of the end wall 100 is generally equal to radial width of the land portion 107 and is between about 15 and 25 per cent of diameter of the piston, thus providing an adequate length of line contact for the outer end 88.

The bleed valve 95 comprises a hollow cylindrical valve body 110 having a central bore 109, open inner and outer ends 111 and 112, and a compression coil valve spring 115 and valve ball 117 extending between the inner and outer ends 111 and 112. Adjacent the outer end 112 of the valve body, the bore 109 is larger in diameter than the adjacent bleed conduit 98 of the piston, so that an annular shoulder 121 defining an inner edge of the bleed conduit 98 is exposed by the central bore 109. The valve ball 117 is smaller in diameter than the central bore 109, and larger in diameter than the bleed conduit 98. The ball 117 is therefore forced by the valve spring 115 against the annular shoulder 121 which serves as a valve seat for the bleed conduit 98. The bore at the outer end of the valve body is thus closely adjacent and aligned with the bleed conduit 98 of the piston. The outer end 112 of valve body 111 has an annular outer flange 119 extending therearound, and an outer coil of the piston spring 90 engages the flange 119 and forces the end 112 against the outer end portion of the piston. This maintains the adjacent ends of the conduit 98 and the bore 109 aligned with each other. Thus, it can be seen that the bleed valve 95 is a ball check valve having the ball 117 spring-urged against a valve seat which cooperates with the bleed conduit 98 of each cylinder.

OPERATION

The pump operates in a manner generally similar to that of a conventional helm pump, the major difference relating to the simplified structure of the bleed valves. The bleed valves are necessary only immediately after installation or servicing of the system, when air must be bled from the system. In normal operation of the pump, as the rotor 28 rotates through 180 degrees about the axis 14, a particular piston in a particular cylinder moves from a minimum volume position to a maximum volume position, concurrently admitting fluid inwardly into the respective cylinder through one of the conduits 38 or 39 to accommodate the expanding volume thereof. When the rotor rotates through another 180 degrees, the particular piston returns to the minimum volume position, concurrently displacing fluid outwardly through the remaining conduit 38 or 39. As there is negligible air in the fluid the bleed valves remain closed during this normal operation.

However, after installation or servicing of the system, portions of the system contain air and insufficient fluid, and thus air must be bled from the system and fluid must be added. Because the system is normally closed, and the pump housings are normally sealed, each housing serves as a sump for the system, or a portion thereof. As the system is being filled with fluid, air can be trapped in upper portions of the housing, the cylinders and as fine bubbles in the fluid.

Referring to FIG. 1, it can be seen that, when the pump 10 is mounted with the axis 14 horizontal as shown, any air trapped in the pistons or cylinders of the rotor can be purged from that particular piston or cylinder as the piston is reciprocated between the extreme positions thereof by rotating the rotor as follows. When a particular cylinder volume is expanding, fluid pressure within the particular cylinder is lower than fluid pressure within the interior of the pump housing itself, and thus the ball 117 of the bleed valve is lifted off the seat 121 and admits fluid and any entrained air through the bleed conduit 98 from the housing interior. Any air in the fluid drawn into the cylinder of the pump piston through the fluid conduit 38 or 39 tends to mix with that drawn through the bleed valve. When the particular cylinder volume contracts, the bleed valve closes and the mixture of fluid and air is discharged outwardly from the helm pump into the remainder of the system. Some air entrained in the oil as small bubbles will unite to form larger bubbles and, due to buoyancy thereof, will tend to move upwardly through the system. The uppermost component of the system in which the helm pump 10 forms a part can be vented to atmosphere to allow accumulated trapped air separated from the fluid to escape. As the system is operated over a period of time, and more fluid flows between the various components thereof, the air bubbles in the system will eventually rise to the uppermost component where they can be vented to atmosphere. By adding fluid as needed to make up for volume lost by vented air, any "sponginess" in the system due to entrained air will disappear as the system eventually becomes filled with fluid. It can be seen that no unusual operator procedure is required to bleed the system.

It is noted that an inwardly disposed portion of the end face 100 adjacent the housing axis 14 contacts the swash plate when the piston at top dead centre, i.e. disposed inwardly of the cylinder and axis 75, whereas an outwardly disposed portion of the end face 100 on a side of the cylinder axis remote from the housing axis 14 contacts the bearing plate in a bottom dead centre position. Thus, similarly to prior art pumps, as the plate 71 sweeps the end wall 100 of the piston, the contact lines on the end wall are variable which can result in a slight rotation of the piston about the cylinder axis 75 as the rotor rotates about the axis 14.

While specific embodiments of the invention have been described and illustrated, such embodiments should be considered illustrative of the invention only and not as limiting the invention as construed in accordance with the accompanying claims.

What is claimed is:

1. A swash plate pump comprising:

(a) a pump housing having a longitudinal housing axis extending between opposite first and second end portions of the housing, (b) a pump rotor journalled for rotation relative to the housing about the housing axis, the pump rotor having a plurality of cylinders therein, (c) a plurality of pistons, each piston having inner and outer ends and being slidable within a respective cylinder of the rotor along a respective cylinder axis, (d) a swash plate having a bearing plate engaging the outer ends of the pistons, the bearing plate being inclined at a swash plate angle to the longitudinal housing axis, (e) inlet and outlet conduits communicating with the cylinders, the conduits having respective valves for supplying fluid to and for discharging fluid from each cylinder, and (f) bleed conduits for bleeding the cylinders, a bleed conduit being provided in the outer end of each respective piston, each bleed conduit having an opening disposed on the respective cylinder axis, the outer end of each piston being partially conical and having a truncated conical end wall extending around the bleed conduit to provide access to the bleed conduit between the bearing plate and the outer end of the piston, and to provide line contact between the truncated conical end wall and the bearing plate of the swash plate.

2. A pump as claimed in claim 1, in which:

(a) the cylinder axes are parallel to the longitudinal housing axis, and (b) the truncated conical end wall of each piston is inclined to the respective cylinder axis at an end face angle, the end face angle being equal to the swash plate angle, so that when the bearing plate of the swash plate engages the outer end wall of the piston, there is line contact between the end wall of the piston and the bearing plate.

3. A pump as claimed in claim 2, in which:

(a) the truncated conical end wall has a radial width of between about 15 and 25 per cent of diameter of the piston.

4. A pump as claimed in claim 1, in which:

(a) the outer end of each piston has an annular step extending concentrically around the truncated conical end wall of the piston, and an outer truncated conical land portion extending around the annular step and being spaced inwardly from the conical end wall portion towards the inner end of the piston, so that the outer land portion is recessed with respect to the conical end wall to avoid interference with the bearing plate.

5. A pump as claimed in claim 4, in which:

(a) radial widths of the truncated conical end wall and the outer truncated conical land portion are approximately equal.

6. A pump as claimed in claim 1, further comprising:

(a) a pressure responsive bleed valve cooperating with the bleed conduit of each cylinder.

7. A pump as claimed in claim 6, in which:

(a) the bleed valve is a ball check valve having a ball spring-urged against a valve seat cooperating with the bleed conduit.

8. A pump as claimed in claim 7, in which:

(a) the bleed valve comprises a valve body having a central bore extending between open inner and outer ends of the valve body, and a valve spring located within the central bore and urging the valve ball against the valve seat which is located adjacent the outer end of the central bore, the valve body having an outer flange generally adjacent the outer end of the piston, and (b) a piston coil spring extends between the outer flange of the valve body and an inner end face of the cylinder so as to force the valve body adjacent the outer end of the piston to hold the body of the bleed valve in place.

9. A pump as claimed in claim 1, further comprising:

(a) a drive shaft extending through and being journalled for rotation relative to the first end portion of the housing, the drive shaft cooperating with the rotor to rotate the rotor, and (b) a rotor engaging shaft extending from the second end portion of the housing along the longitudinal housing axis, the engaging shaft having the inlet and outlet conduits.

10. A pump as claimed in claim 9, further comprising:

(a) a valve housing secured to the second end portion of the housing adjacent the engaging shaft, the valve housing communicating with the inlet and outlet conduits of the shaft, the valves of the conduits including inlet and outlet valves mounted in the valve housing.

11. A swash plate pump comprising:

(a) a pump housing having a longitudinal housing axis extending between opposite first and second end portions of the housing, (b) a pump rotor journalled for rotation relative to the housing about the housing axis, the pump rotor having a plurality of cylinders therein, (c) a plurality of pistons, each piston having a piston axis and inner and outer ends and being slidable within a respective cylinder of the rotor along a respective cylinder axis, (d) a swash plate having a bearing plate engaging the outer ends of the pistons, the bearing plate being inclined at a swash plate angle to the longitudinal housing axis, (e) inlet and outlet conduits communicating with the cylinders, the conduits having respective valves for supplying fluid to and for discharging fluid from each cylinder, (f) bleed conduits for bleeding the cylinders, a bleed conduit being provided in the outer end of each respective piston, each bleed conduit being straight and extending axially of the respective cylinder so as to have openings on the respective piston axis, the outer end of each piston being shaped to provide access to the bleed conduit between the bearing plate and the outer end of the piston, and (g) a plurality of pressure responsive bleed valves, each bleed valve being located in and cooperating with a bleed conduit of a respective cylinder.

12. A pump as claimed in claim 1, in which:

(a) the outer ends of the pistons are partially conical and have a truncated conical end wall extending around the bleed conduit.

13. A pump as claimed in claim 11, in which:

(a) line contact exists between the truncated conical end wall and the bearing plate of the swash plate.

14. A pump as claimed in claim 11, in which:

(a) each bleed valve is a ball check valve having a valve ball spring-urged against a valve seat cooperating with a respective bleed conduit.

15. A pump as claimed in claim 14, in which:

(a) each ball check valve is responsive to a pressure differential across the valve seat and opens when pressure inside the cylinder is less than pressure outside the cylinder.

16. A pump as claimed in claim 14, in which:

(a) the bleed valve comprises a valve body having a central bore extending between open inner and outer ends of the valve body, and a valve spring located within the central bore and urging the valve ball against the valve seat which is located adjacent the outer end of the central bore, the valve body having an outer flange generally adjacent the outer end of the piston, and (b) a piston coil spring extends between the outer flange of the valve body and an inner end face of the cylinder so as to force the valve body adjacent the outer end of the piston to hold the body of the bleed valve in place.

* * * * *